US012599259B1

(12) United States Patent
Diecidue

(10) Patent No.: US 12,599,259 B1
(45) Date of Patent: Apr. 14, 2026

(54) ICE RESTRAINING DEVICE

(71) Applicant: Antonino Diecidue, Newton, NJ (US)

(72) Inventor: Antonino Diecidue, Newton, NJ (US)

( * ) Notice: Subject to any disclaimer, the term of this patent is extended or adjusted under 35 U.S.C. 154(b) by 0 days.

(21) Appl. No.: 18/392,559

(22) Filed: Dec. 21, 2023

Related U.S. Application Data

(60) Provisional application No. 63/434,336, filed on Dec. 21, 2022.

(51) Int. Cl.
*A47G 19/22* (2006.01)

(52) U.S. Cl.
CPC ..... *A47G 19/2211* (2013.01)

(58) Field of Classification Search
CPC . A63B 67/06; A63B 2210/50; A67G 19/2211; A67G 19/2205; A67G 19/22; A67G 19/2272; A67G 19/2288
USPC ..... 220/703, 719
See application file for complete search history.

(56) References Cited

U.S. PATENT DOCUMENTS 586,833 A * 7/1897 Brown ..... B01D 17/0214 210/469
2,529,114 A * 11/1950 Tellier ..... A47G 19/2272 138/40
2,753,049 A 7/1956 Gaines et al.
3,040,897 A * 6/1962 Holman ..... B65D 1/10 426/115
3,549,044 A 12/1970 Lerner
D407,944 S 4/1999 Filbrun
5,971,202 A 10/1999 Filbrun
11,185,178 B1 11/2021 Nobari
11,241,110 B2 * 2/2022 Cudworth ..... F16K 7/12
2008/0156817 A1 * 7/2008 Roseblade ..... B65D 51/24 220/780
2011/0309092 A1 12/2011 Gatta
2012/0024873 A1 2/2012 Roseblade et al.
2021/0188490 A1 * 6/2021 Cohan ..... B65D 43/0202

FOREIGN PATENT DOCUMENTS

GB 2539682 A 12/2016

* cited by examiner

*Primary Examiner* — King M Chu
(74) *Attorney, Agent, or Firm* — John Rizvi; John Rizvi, P.A.—The Patent Professor ®

(57) ABSTRACT

A flexible ice restraining device for restraining ice cubes within a container is disclosed. The ice restraining device comprises a central finger grip portion comprising a pair of finger ports configured to receive fingers of a user to facilitate manipulation of the ice restraining device relative to the container. The ice restraining device comprises a plurality of securing arms extending radially outward from the central finger grip portion, and configured to flex when in engagement with an interior of the container thereby shifting the ice restraining device from a relaxed condition to a flexed condition. The ice restraining device comprises a plurality of perforated areas formed between corresponding securing arms, wherein the plurality of perforated areas are configured to allow a liquid within the container to pass there-through while the central finger grip portion and the plurality of securing arms restrain the ice cubes within the container.

18 Claims, 12 Drawing Sheets

ICE RESTRAINING DEVICE

CROSS-REFERENCE TO RELATED APPLICATIONS

This application claims the benefit of U.S. Provisional Patent Application Ser. No. 63/434,336 filed on Dec. 21, 2022, which is incorporated by reference herein in its entirety.

FIELD OF THE INVENTION

The present invention relates generally to ice restraining devices for containers, and more particularly, to a flexible ice restraining device formed from a food grade silicone and having finger ports to insert the flexible ice restraining device into a container.

BACKGROUND OF THE INVENTION

Liquids, such as juices, alcoholic beverages, sodas, etc. are often served within containers such as glasses or cups and kept cold by placing ice cubes into the containers with the liquids. When a user wished to drink the liquid, the container is tipped back or up to allow the liquids to flow out a top opening of the container and into the user's mouth.

Frequently, the ice cubes within the container flow out with the liquids and hit the user's mouth or teeth causing an uncomfortable and often messy situation. Various devices have been developed to restrain the ice cubes within the containers while the user drinks the liquid. Some such devices include inwardly directed lips on the openings of the cup, but the ice can still pass over the lips if the container is tilted back far enough.

Other devices fit within the containers themselves to allow the liquid to flow while restraining the ice within the containers. These devices are difficult to insert into the container and, more importantly, are difficult to remove. Further, these devices are formed from a variety of materials that impart a different or even unpleasant taste to the liquid.

Accordingly, there is need for a solution to at least one of the aforementioned problems. For instance, there is an established need for an ice restraining device that is easy to insert into and remove from a container. There is a further established need for an ice restraining device that does not impart a different or objectionable taste to the liquid.

SUMMARY OF THE INVENTION

The present invention is directed to a flexible ice restraining device for retaining ice cubes within a container while allowing liquid to pass through the ice restraining device. The ice restraining device generally includes a central finger grip portion defining a pair of finger ports there through and a plurality of flexible securing arms extending radially outwardly from the central finger grip portion. The area between the securing arms form perforated areas through the ice restraining device for the passage of liquids.

In a one implementation of the invention, a flexible ice restraining device for restraining ice cubes within a container is disclosed, the ice restraining device comprising: a central finger grip portion defining a pair of finger ports; a plurality of securing arms extending radially outward from the finger grip portion, wherein at least the plurality of securing arms are flexible.

In an aspect, the ice restraining device may be formed from a food grade silicone.

In another implementation of the invention, a method for restraining ice cubes within a container is disclosed, the ice restraining device method comprising: providing an ice restraining device having a central finger grip portion defining a pair of finger ports, and a plurality of flexible securing arms extending radially outward from the finger grip portion, wherein the ice restraining device is formed from a food grade silicone; gripping the ice restraining device by inserting fingers into the pair of finger ports; and pushing the ice restraining device into a container such that the plurality of flexible fingers flex within the container.

In yet another implementation of the invention, a flexible ice restraining device for restraining ice cubes within a container is disclosed. The ice restraining device comprises: a central finger grip portion comprising a pair of finger ports configured to receive fingers of a user to facilitate manipulation of the ice restraining device relative to the container; a plurality of securing arms extending radially outward from the central finger grip portion, wherein the plurality of securing arms are configured to flex when in engagement with an interior of the container thereby shifting the ice restraining device from a relaxed condition to a flexed condition; and a plurality of perforated areas formed between corresponding securing arms of the plurality of securing arms, wherein the plurality of perforated areas are configured to allow a liquid within the container to pass there-through while the central finger grip portion and the plurality of securing arms restrain the ice cubes within the container.

In an aspect, the ice restraining device may be formed of a sheet of food grade silicon.

In an aspect, each securing arm of the plurality of securing arms may comprise a first end adjacent the central finger grip portion and a free second end for engaging the interior of the container upon being inserted within the container.

In an aspect, each securing arm of the plurality of securing arms may have a rectangular configuration.

In an aspect, each securing arm of the plurality of securing arms has a triangular configuration.

In an aspect, the central finger grip portion and the plurality of securing arms may be integrally formed.

In an aspect, the pair of finger ports may include a first finger grip port and a second finger grip port spaced part from the first finger grip port, wherein each of the first finger grip port and the second finger grip port are D-shaped ports.

In an aspect, the pair of finger ports may include a first finger grip port and a second finger grip port spaced part from the first finger grip port, wherein each of the first finger grip port and the second finger grip port are circular ports.

In yet another implementation of the invention, a flexible ice restraining device for restraining ice cubes within a container is disclosed. The ice restraining device comprises: a central finger grip portion comprising a pair of finger ports configured to receive fingers of a user to facilitate manipulation of the ice restraining device relative to the container; a first set of securing arms and a second set of securing arms extending radially outward from the central finger grip portion, wherein each of the first set of securing arms and the second set of securing arms are configured to flex when in engagement with an interior of the container, and a plurality of perforated areas formed between corresponding securing arms of the first set of securing arms and the second set of securing arms, wherein the plurality of perforated areas are configured to allow a liquid within the container to pass there-through while the central finger grip portion, the first set of securing arms, and the second set of securing arms restrain the ice cubes within the container.

In an aspect, the first set of securing arms may have a greater length compared to the length of the second set of securing arms.

In an aspect, each securing arm of the first set of securing arms and the second set of securing arms may comprise a first end adjacent the central finger grip portion and a free second end for engaging the interior of the container upon being inserted within the container, wherein the second ends of the first set of securing arms are narrower compared to the second ends of the second set of securing arms.

In an aspect, the pair of finger ports may include a first finger grip port and a second finger grip port spaced part from the first finger grip port, wherein each of the first finger grip port and the second finger grip port are rectangular ports.

In an aspect, the ice restraining device may be formed of a sheet of food grade silicon.

In yet another implementation of the invention, a flexible ice restraining device for restraining ice cubes within a container is disclosed. The ice restraining device may comprise: a central finger grip portion comprising a pair of finger ports configured to receive fingers of a user to facilitate manipulation of the ice restraining device relative to the container; a plurality of primary securing arms extending radially outward from the central finger grip portion; a plurality of primary perforated areas formed between corresponding securing arms of the plurality of primary securing arms; and a plurality of secondary arms extending radially outward from the central finger grip portion and extending into the plurality of primary perforated areas, wherein at least the plurality of primary securing arms are configured to flex when in engagement with an interior of the container, and wherein the plurality of primary perforated areas are configured to allow a liquid within the container to pass there-through while the central finger grip portion, the plurality of primary securing arms, and the plurality of secondary arms restrain the ice cubes within the container.

In an aspect, the flexible ice restraining device may further comprise a plurality of secondary perforated areas defined between corresponding secondary arms and the central finger grip portion, the plurality of secondary perforated areas being configured to allow the liquid within the container to pass there-through.

In an aspect, each of the plurality of primary securing arms may comprise a pair of extension arms extending from corresponding primary securing arms into the corresponding primary perforated areas.

In an aspect, the ice restraining device may be formed of a sheet of food grade silicon.

In an aspect, the pair of finger ports may include a first finger grip port and a second finger grip port spaced part from the first finger grip port, wherein each of the first finger grip port and the second finger grip port are triangular ports.

In an aspect, each of the plurality of secondary perforated areas may be diamond shaped.

In an aspect, each of the plurality of secondary perforated areas may be triangular shaped.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a flexible ice restraining device for holding ice within a container while allowing liquid to pass through the ice restraining device.

Figure 1:
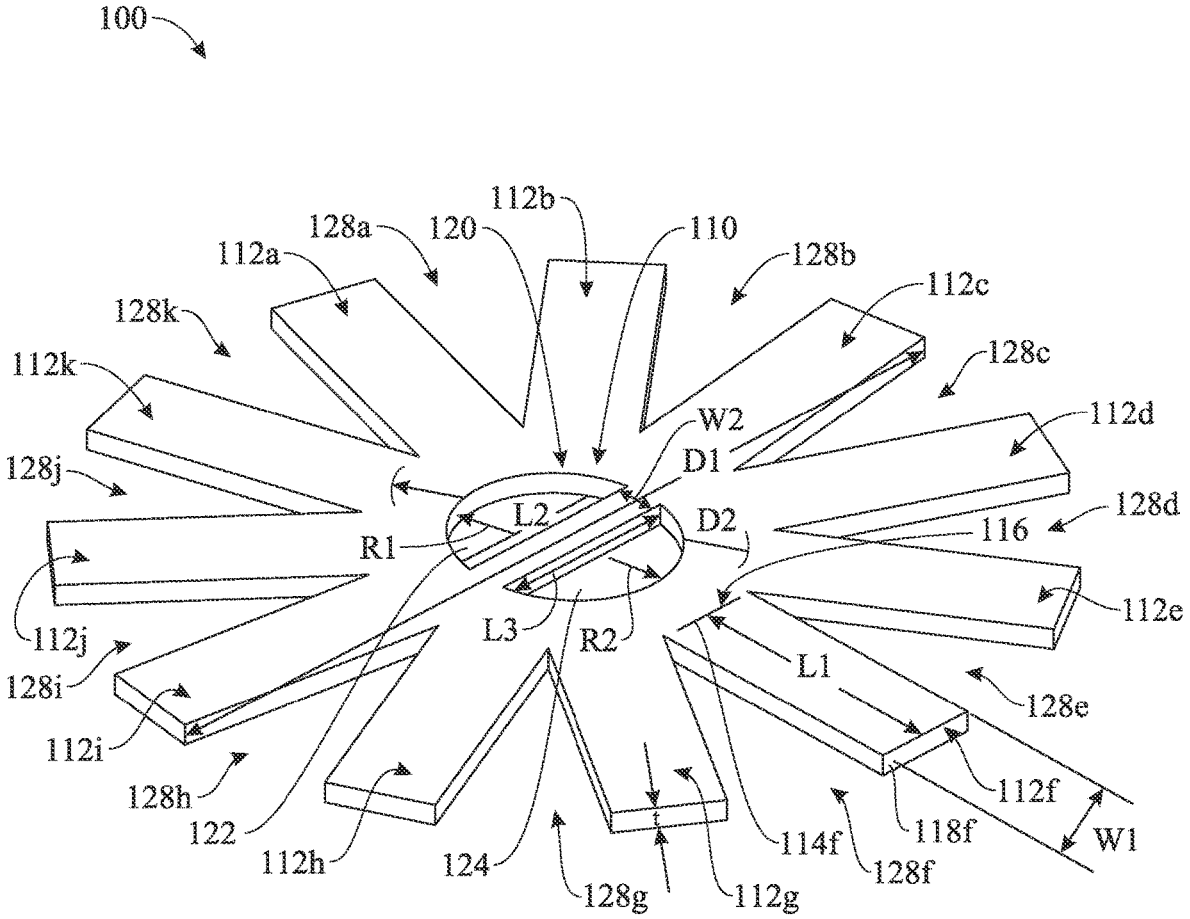
FIG. 1 presents a top, side isometric view of a removable ice restraining device for restraining ice within a container in accordance with a first illustrative embodiment of the present invention.
Figure 2:
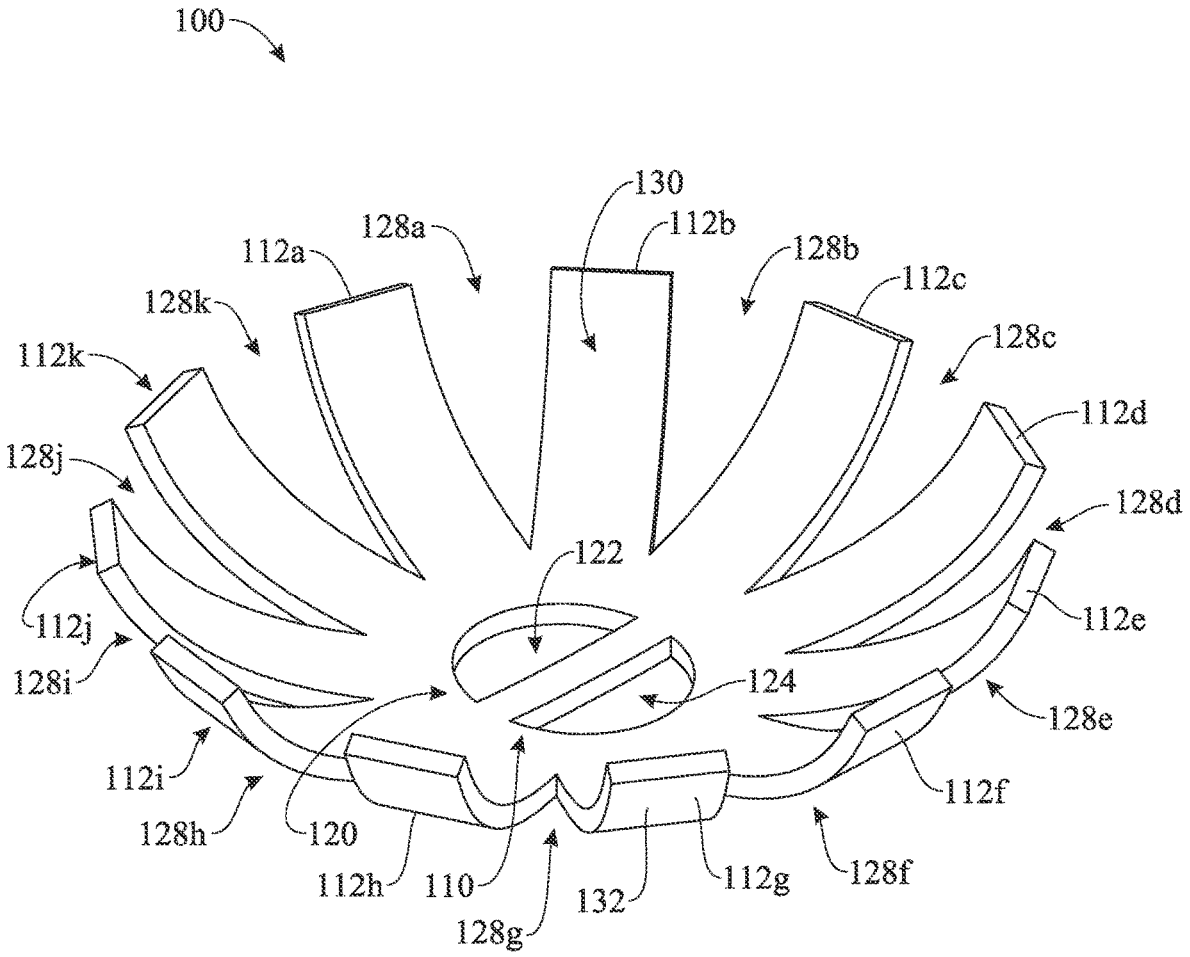
FIG. 2 presents a top, side isometric view of the removable ice restraining device for restraining ice within a container illustrated in FIG. 1 with securing arms of the removable ice restraining device in a flexed condition.

Referring to FIGS. 1-6, and initially with regard to FIGS. 1 and 2, a flexible ice restraining device for use in restraining ice within a container, hereinafter ice restraining device 100, is illustrated in accordance with a first exemplary embodiment of the present invention. As shown for instance in FIG. 1, the ice restraining device 100 includes a circular central finger grip portion 110 and a plurality of flexible securing arms 112*a-k* extending radially outward from the finger grip portion 110. Each securing arm 112, for example securing arm 112*f*, has a first end 114*f* extending from an outer edge or limit 116 of the finger grip portion 110 and a free second end 118*f* for engaging an interior of a container as discussed in more detain hereinbelow. It should be noted that, while eleven securing arms 112*a-k* are illustrated, the disclosed ice restraining device 100 may be provided with more or fewer securing arms 112.

In order to facilitate insertion and removal of the ice restraining device 100 into and out of an interior of a container, the finger grip portion 110 of the ice restraining device 100 includes a pair of finger grip ports 120 defined in the finger grip portion 110. The pair of finger grip ports 120 are provided to accommodate or receive fingers of a user to facilitate manipulation of the ice restraining device 100 relative to a container. The pair of finger grip ports 120 include a D-shape first finger grip port 122 and a similarly D-shaped second finger grip port 124. The first and second finger grip ports 122 and 124, respectively, are spaced apart by a length of spacer 126 formed in the finger grip portion 110 of the ice restraining device 100.

It should be noted that, while the finger grip portion 110 of the ice restraining device 100 defines D-shaped finger grip ports 120, other shapes are also contemplated such as, for example, circular, oval, rectangular, triangular and/or other symmetrical or asymmetrical shapes. Additionally, the first and second finger grip ports 122 and 124 need not have identical shapes to accomplish the desired function of receiving a user's fingers.

The disclosed ice restraining device 100 is formed from a sheet of flexible and biocompatible material such as, for example, food grade silicon Food grade silicone is the preferred material of construction as it is non-toxic and does not affect the taste of a beverage that it may come into contact with. The disclosed ice restraining device 100 may be formed in a variety of ways such as, for example stamping, machine and/or hand cutting, laser printing, etc. It should be noted that the finger grip portion 110 and the securing arms 112 may be formed integrally or may be formed separately and subsequently joined by various known methods such as, for example, gluing, fusing, welding, etc. Additionally, the finger grip portion 110 may be as flexible as the securing arms 112 or may be treated or formed separately to be slightly less flexible than the securing arms 112 to stiffen the finger grip portion 110 for ease of handling.

When forming the ice restraining device from the chosen sheet of material, the process leaves open areas or perforations as, in this particular embodiment, primary perforations or perforated areas 128*a-k* defined between the securing arms 112*a-k*. When the ice restraining device 100 is inserted into a container to restrain ice therein, liquid located within the container is free to flow between the securing arms 112*a-k* through the perforated areas 128*a-k*.

In this particular embodiment, the ice restraining device 100 is formed from a sheet of food grade silicone having a thickness "t' and has an overall outer diameter "D1". In one embodiment, the thickness "t" is approximately ⅛" and the outer diameter D1 is approximately 100 mm. The circular central finger grip portion 110 has a diameter "D2" and the securing arms 112*a-k* have a length L1 and a width "W1". It should be noted that the dimensions of the ice restraining device can cover a wide variety of thicknesses, diameters, lengths and widths depending on the suitability for a particular application and use.

As shown, the first finger grip port 122 is D-shaped having a length "L2" and a radius "R1". Similarly, the second finger grip port 124 is also D-shaped having a length "L3" and a radius "R2". In a preferred embodiment, the length L2 of the first finger grip port 122 is substantially identical to the length L3 of the second finger grip port 124 and the radius R1 of the first finger grip port 122 is substantially identical to the radius R2 of the second finger grip port 124. The spacer 126 between the first and second finger grip ports 122 and 124 has a width W2. The lengths and radii of the first and second finger grip ports 122 and 124 may also vary depending upon the particular application and use.

Turning now to FIG. 2, the ice restraining device has a first side 130 and a second side 132. When inserted into a container having an internal diameter smaller than the outer diameter D1 of the ice restraining device 100, the securing arms 112*a-k* flex such that the first side 130 of the ice restraining device has a concave shape and the second side 132 of the ice restraining device 100 has a convex shape. As noted hereinabove, the finger grip portion 110 may or may not flex with the securing arms 112*a-k*. Thus, the ice restraining device 100 is movably or flexed between a relaxed condition (FIG. 1) and the flexed condition (FIG. 2).

Figure 3:
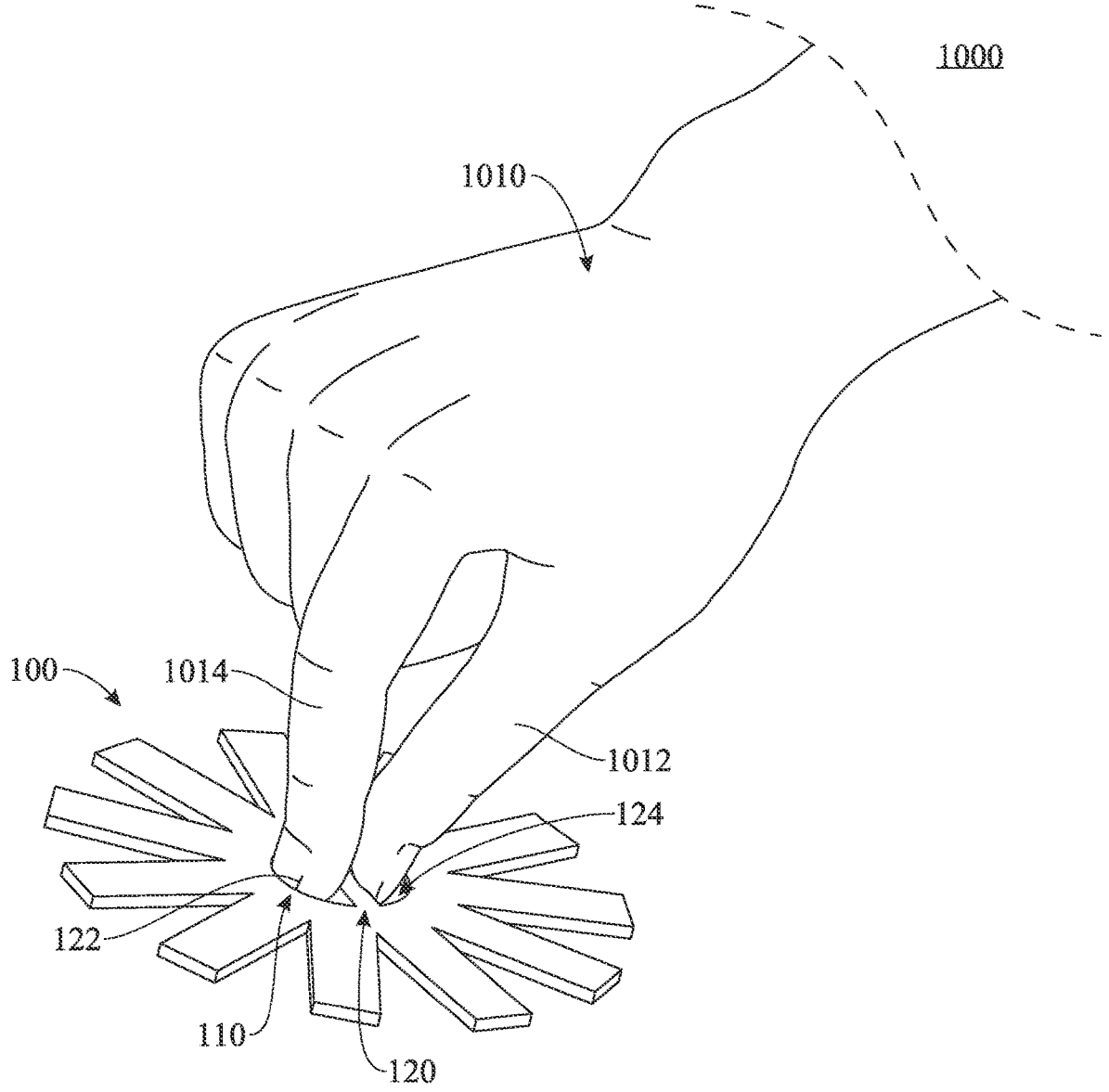
FIG. 3 presents a top, side isometric view of the removable ice restraining device for restraining ice within a container of FIG. 1, with the removable ice restraining device in a relaxed condition and being grasped by fingers of a user for insertion into a container.

Turning now to FIGS. 3-6, and initially with regard to FIG. 3, in use, a user 1000 having a hand 1010 initially grasps the finger grip portion 110 of the ice restraining device 100. More specifically, the two of the user 1000's fingers, such as, for example the user 1000's thumb 1012 and forefinger 1014, are inserted into the first and second finger grip ports 122 and 124, respectively, of the pair of finger grip ports 120 to grip and manipulate the ice restraining device 100.

Figure 4:
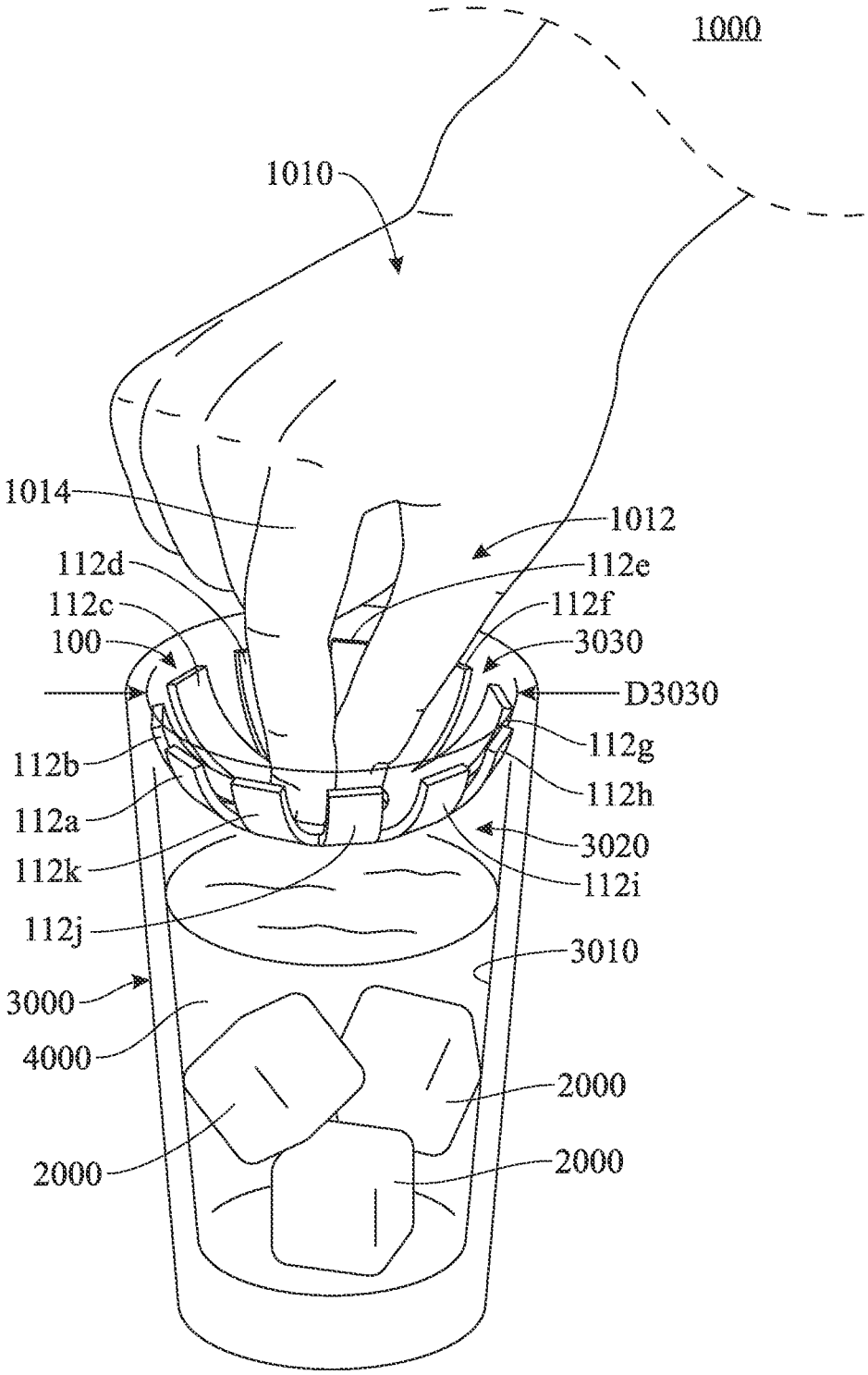
FIG. 4 presents a top, side isometric view of the removable ice restraining device for restraining ice within a container of FIG. 1, with the removable ice restraining device being bent into the flexed condition during insertion of the removable ice restraining device into a container by the user.

As best shown in FIG. 4, the ice restraining device 100 is provided to restrain ice, such as, for example ice cubes 2000, within a container 3000. The container 3000 is a glass or cup having an inner surface 3010 defining a hollow interior 3020 and a top opening 3030. The ice restraining device 100 is provided to restrain the ice cubes 2000 within the hollow interior 3020 of the container 3000 while allowing a liquid located in the container 3000, such as, for example liquid 4000, to pass through the ice restraining device 100.

After grasping the finger grip portion 110 of the ice restraining device 100, the user 1000 forces the ice restraining device 100 into the top opening 3030 of the container 3000. By providing the pair of finger ports 120 in the central finger grip portion 110 of the ice restraining device 100, the user 1000 can easily push and pull the ice restraining device into and out of the container 3000.

Figure 5:
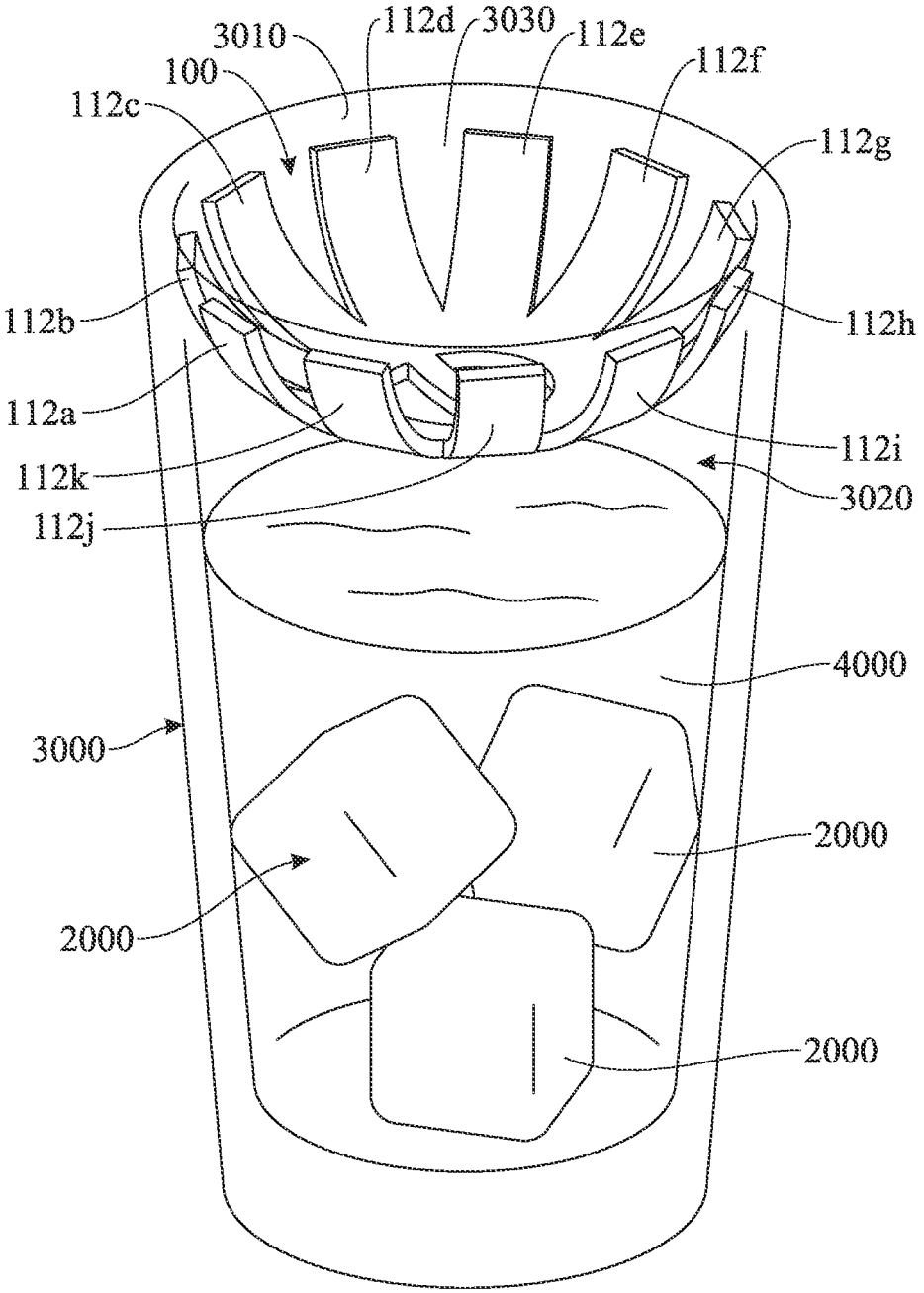
FIG. 5 presents a side isometric view of the removable ice restraining device for restraining ice within a container of FIG. 1 in the flexed condition and inserted into the container over liquid and ice cubes contained within the container.

The top opening 3030 of the container 3000 has a diameter "D3030" which is less than the outer diameter D1 (FIG. 1) of the ice restraining device 100 in the relaxed condition (FIG. 1). As the ice restraining device 100 is forced into the container 3000 the securing arms 112*a*-*k* of the ice restraining device 100 are flexed such that the ice restraining device 100 assumes the flexed concave/convex shape described hereinabove. The securing arms 112*a*-*k* of the now flexed ice restraining device 100 are forced against the inner surface 3010 of the container 3000 to secure the ice restraining device 100 within the container 3000 and over the ice cubes 2000 as best shown in FIG. 5.

Figure 6:
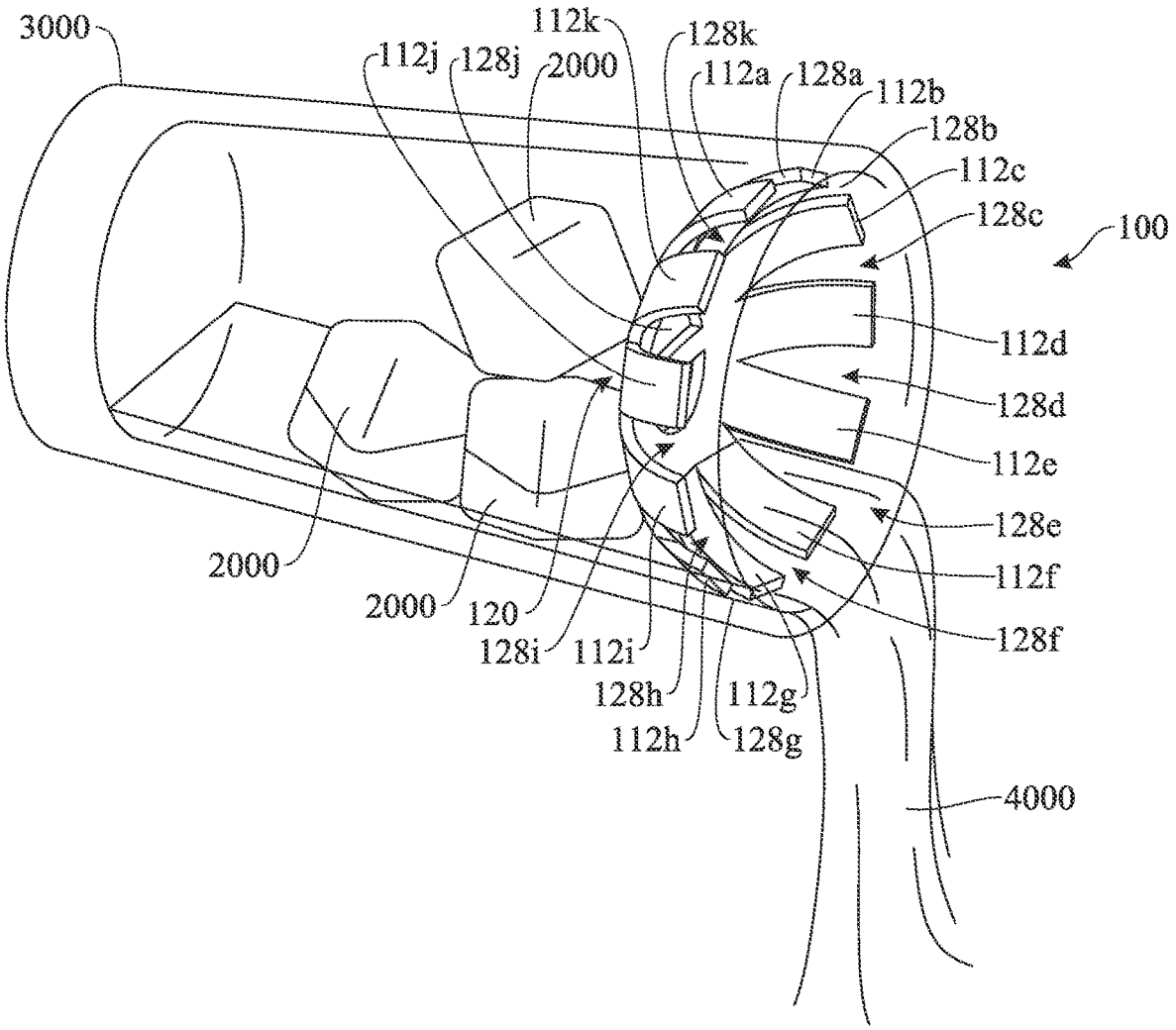
FIG. 6 presents a side isometric view of the removable ice restraining device for restraining ice cubes within a container of FIG. 1 in the flexed condition within the container and restraining the ice in the container while allowing liquid to pass through the removable ice restraining device.

Referring to FIG. 6, as the container 3000 is tilted to allow the user 1000 to drink the liquid 4000 contained in the container 3000, the liquid 4000 is free to pass through the open or perforated areas 128*a*-*k* defined between the securing arms 112*a*-*k*. The ice cubes 2000, which are larger than the perforated areas 128*a*-*k*, are restrained or prevented from passing out of the container 3000 by the ice restraining device 100. Once the user 1000 has finished drinking the liquid 4000 or wishes to remove the ice restraining device 100 from the container 3000, the finger grip portion 120 of the ice restraining device 100 can be regrasped by inserting the users fingers, i.e. the thumb and forefinger 1012 and 1014 in the first and second finger grip ports 122 and 124 of the finger grip portion 110 (FIG. 4) and used to pull the ice restraining device out of the container 3000. Being flexible, the ice restraining device 100 will invert as the user pulls the ice restraining device 100 of the container 3000. Thus, the disclosed ice restraining device 100 provides a safe, removable and easy device and method for restraining ice cubes 2000 within a container 3000.

Figure 7A:
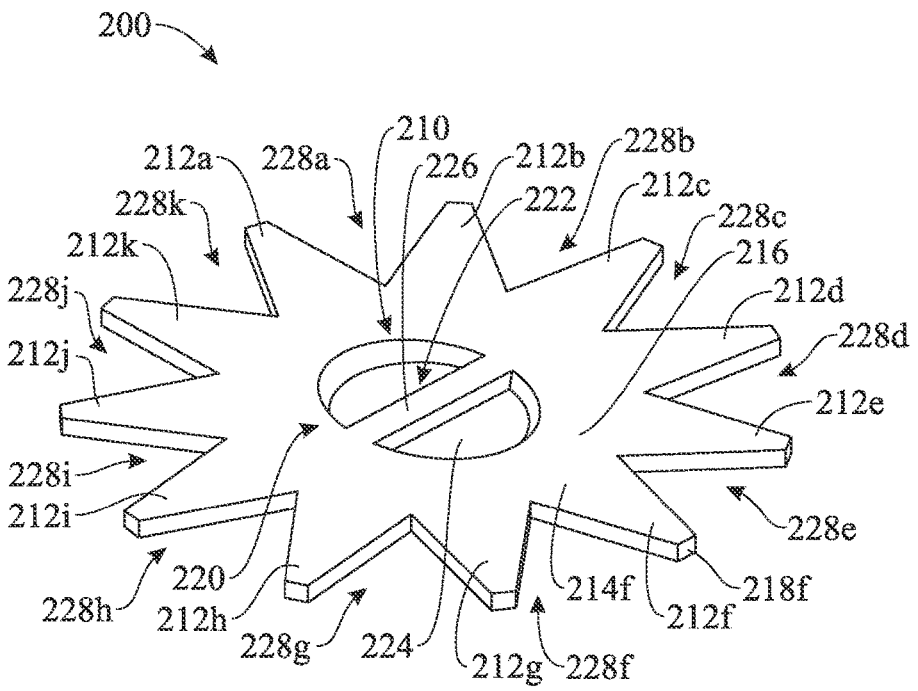
FIG. 7A presents a top, side isometric view of a removable ice restraining device for restraining ice within a container in accordance with a second illustrative embodiment of the present invention in a relaxed condition and including triangular shaped securing arms.
Figure 7B:
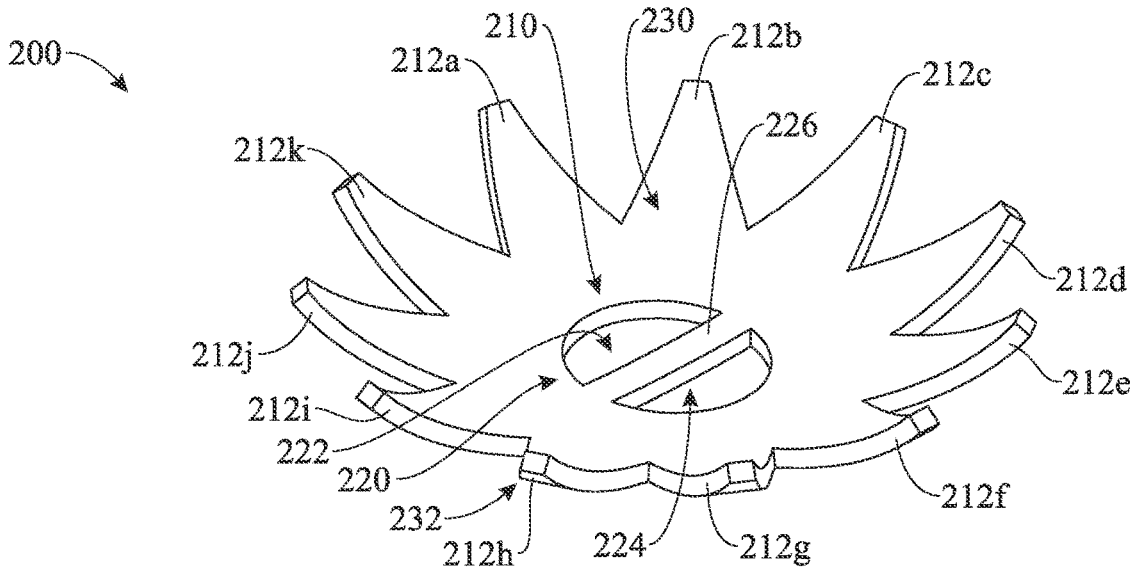
FIG. 7B presents a top, side isometric view of a removable ice restraining device for restraining ice within a container of FIG. 7A in a flexed condition.

Turning now to FIGS. 7A and 7B, there is disclosed an alternative embodiment of an ice restraining device 200 in accordance with the present invention. The ice restraining device 200 is similar to the ice restraining device 100 described hereinabove and generally includes a circular central finger grip portion 210 having flexible securing arms 212*a*-*k* extending radially outward from the finger grip portion 210. Each securing arm 212, for example securing arm 212*f*, has a first end 214*f* extending from an outer edge or limit 216 of the finger grip portion 210 and a free second end 218*f* for engaging the inner surface 3010 of the container 3000 (FIG. 5).

Similar to the ice restraining device 100 described hereinabove, the ice restraining device 200 includes a pair of finger grip ports 220, defined in the finger grip portion 210, including first and second finger grip ports 222 and 224, respectively. The first and second finger grip ports 22 and 224 are also D-shaped and separated by a spacer 226.

With specific reference to FIG. 7A, it should be noted that, in this embodiment, the securing arms 212*a*-*k* are generally triangular shaped terminating in flat second ends 218. The flat second ends 218 are substantially narrower than the second ends 118 of the securing arms 112*a*-*k* of the ice restraining device 100. The triangular shape of the securing arms 212*a*-*k* results in perforated areas 228*a*-*k*, defined between the securing arms 212*a*-*k*, which are larger than the perforated areas 128*a*-*k* of the ice restraining device 100. Thus, by forming the securing arms 212*a*-*k* in a triangular pattern, the ice restraining device 200 can pass more liquid 4000 through the perforated areas 228*a*-*k* than the ice restraining device 100.

As best shown in FIG. 7B, the ice restraining device 200 has a first side 230 and a second side 232. When the securing arms 212 are flexed during insertion into the container 3000, the first side 230 of the ice restraining device 200 assumes a concave shape while the second side 232 assumes a convex shape. The ice restraining device 200 is also formed from food grade silicone and in the same manners described hereinabove with regard to the ice restraining device 100. Likewise, the ice restraining device 200 is used in similar manner to the ice restraining device 100 to the secure ice cubes 2000 within the container 3000 while allowing the liquid 4000 to pass through the perforated areas 228*a*-*k*.

Figure 8A:
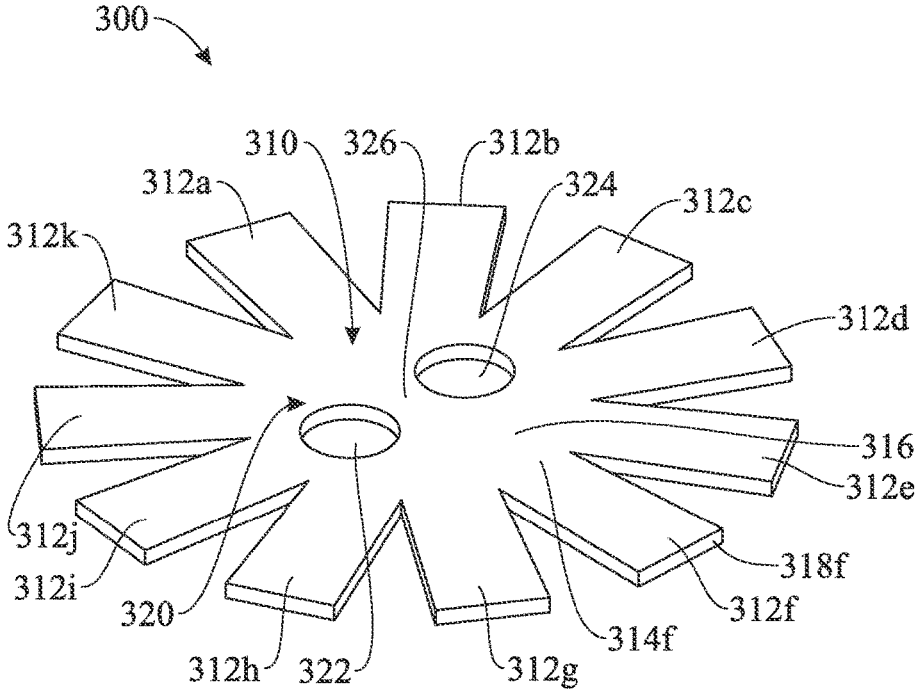
FIG. 8A presents a top, side isometric view of a removable ice restraining device for restraining ice within a container in accordance with a third illustrative embodiment of the present invention in a relaxed condition and including circular finger ports for receipt of a user's fingers.
Figure 8B:
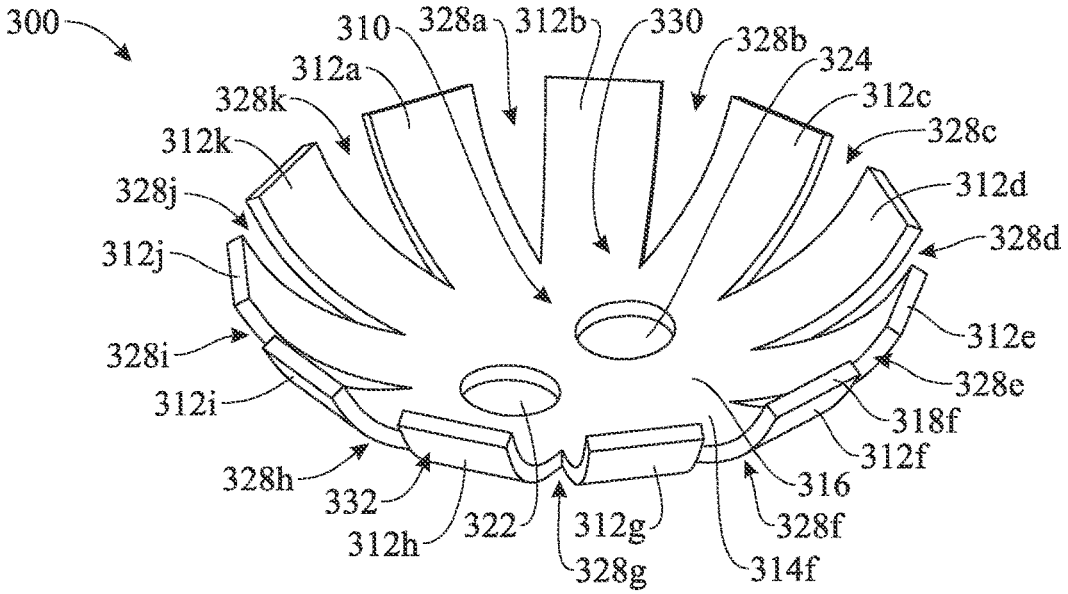
FIG. 8B presents a top, side isometric view of a removable ice restraining device for restraining ice within a container of FIG. 8A in a flexed condition.

Turning now to FIGS. 8A and 8B, there is disclosed another embodiment of an ice restraining device 300 generally including a circular central finger grip portion 310 having a plurality of securing arms 312*a*-*k* extending radially outwardly from the finger grip portion 310. The ice restraining device 300 is similar to the ice restraining device 100 in that the securing arms 312*a*-*k* are also rectangular. The securing arms 312*a*-*k*, for example securing arm 312*f*, has a first end 314*f* extending from an outer edge or limit 316 of the finger grip portion 310 and a free second end 318*f* for engaging the inner surface 3010 of the container 3000 (FIG. 5).

Similar to those embodiments described hereinabove, the ice restraining device 300 includes a pair of finger grip ports 320 defined in the finger grip portion 310 of the ice restraining device 300 including first and second finger grip ports 322 and 324, respectively. However, in the ice restraining device 300, the first and second finger grip ports 322 and 324 are circular rather than D-shaped as in the prior embodiments. This may allow a user 1000 to more easily insert the thumb 1012 and forefinger 1014 into the finger grip portion 310 of the ice restraining device 300. As shown, the first and second finger grip ports 322 and 324 are spaced apart by a spacer 326.

The securing arms 312*a*-*k* of the ice restraining device 300 define perforated areas 328*a*-*k* substantially identical to the perforated areas 128*a*-*k* defined hereinabove with regard to the ice restraining device 100. As best shown in FIG. 8B, the ice restraining device 300 has a first side 330 and a second side 332. When flexed upon insertion into the container 3000, the first side 330 assumes a concave shape and the second side 332 assumes a convex shape. The ice restraining device 300 is also formed from food grade silicone and is constructed as described hereinabove with regard to the ice restraining device 100.

Figure 9A:
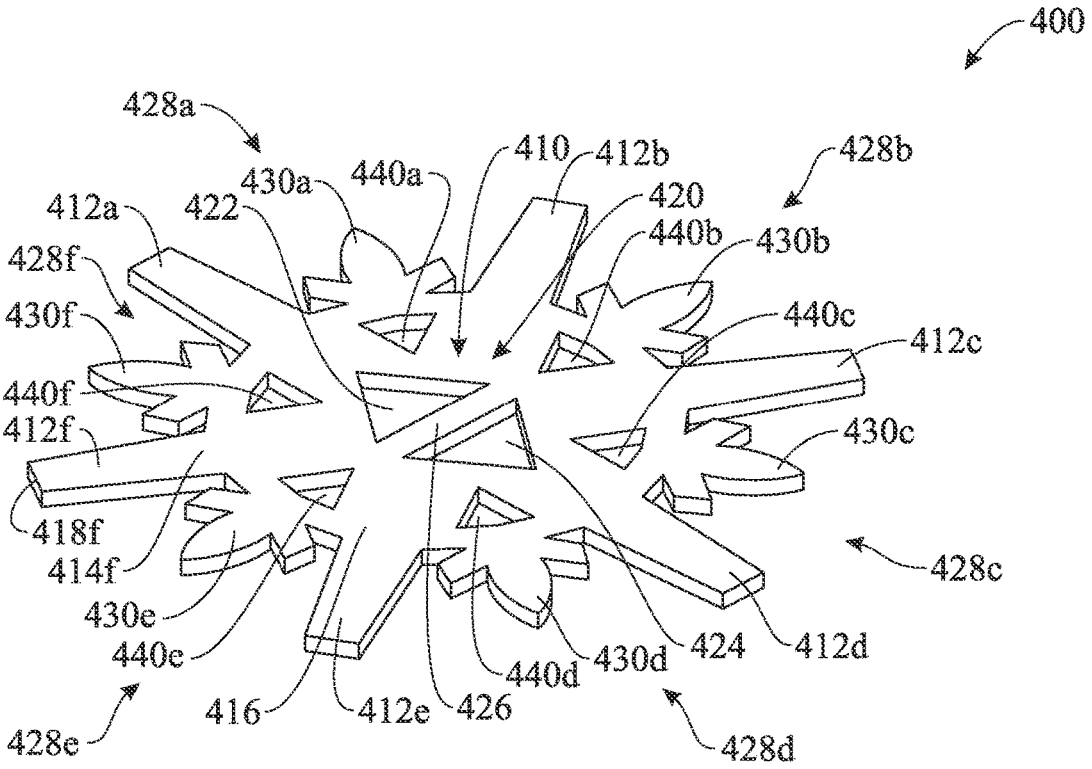
FIG. 9A presents a top, side isometric view of a removable ice restraining device for restraining ice within a container in accordance with a fourth illustrative embodiment of the present invention in a relaxed condition and having a first snowflake shape, triangular finger ports and additional fluid passage ports.
Figure 9B:
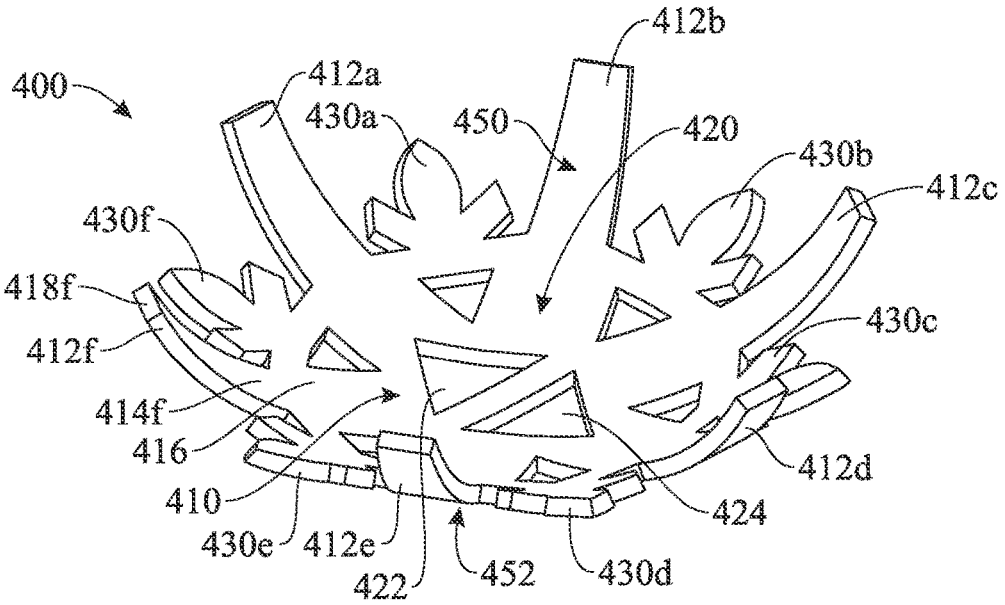
FIG. 9B presents a top, side isometric view of a removable ice restraining device for restraining ice within a container of FIG. 9A in a flexed condition.

Referring now to FIGS. 9A and 9B, there is disclosed a further embodiment of an ice restraining device 400 incorporating decorative elements and additional perforated areas for liquid to flow through. The ice restraining device 400 includes a central finger grip portion 410 having generally trapezoidal shaped securing arms 412*a-f* extending radially outward from the finger grip portion 410. Each of the securing arms 412*a-f*, as best illustrated with regard to securing arm 412*f*, has a first end 414*f* extending from an outer edge 416 of the finger grip portion 410 and terminated in a second end 418*f*. A pair of finger grip ports 420, including first and second finger grip ports 422 and 424, respectively, are defined within the finger grip portion 410 of the ice restraining device 100. In this particular embodiment, the first and second finger grip ports 422 and 424 are triangular. A spacer 426 separates the first and second finger grip ports 422 and 424. In this particular embodiment, there are six securing arms 412, i.e., securing arms 412*a-f*, which define six primary perforated areas 428*a-f* therebetween for the passage of liquid 4000.

As shown, in this particular embodiment, the ice restraining device 400 further includes decorative secondary arms 430*a-f* extending radially outwardly from the outer edge 416 of the finger grip portion 410 and extending into the primary perforated areas 428*a-f*. The secondary arms 430*a-f* may be merely decorative and may also provide an additional securing function by engaging the inner surface 3010 of the container 3000 (FIG. 5) when the ice restraining device 400 is forced down into a narrower area (not shown) of the container 3000.

To compensate for the loss of fluid passage area of the primary perforated areas 428*a-f* due to the presence of the secondary arms 430*a-f*, the ice restraining device 400 includes secondary perforated areas 440*a-f* defined between the secondary arms 430*a-f* and the finger grip portion 410. In this embodiment, the secondary perforated areas 440*a-f* are triangular shaped. Thus, as the container 3000 is tipped over, the liquid 4000 flows not only through the primary perforated areas 428*a-f* and possibly the first and second finger ports 422 and 424 but also through the secondary perforated areas 440*a-f*.

With specific reference to FIG. 9B, the ice restraining device 400 has a first side 450 and a second side 452. When the ice restraining device 400 is inserted into the container 3000 the first side 450 assumes a concave shape while the second side 452 assumes a convex shape. The ice restraining device 400 is formed from a food grade silicone and functions substantially similar to those embodiment described hereinabove.

Figure 10A:
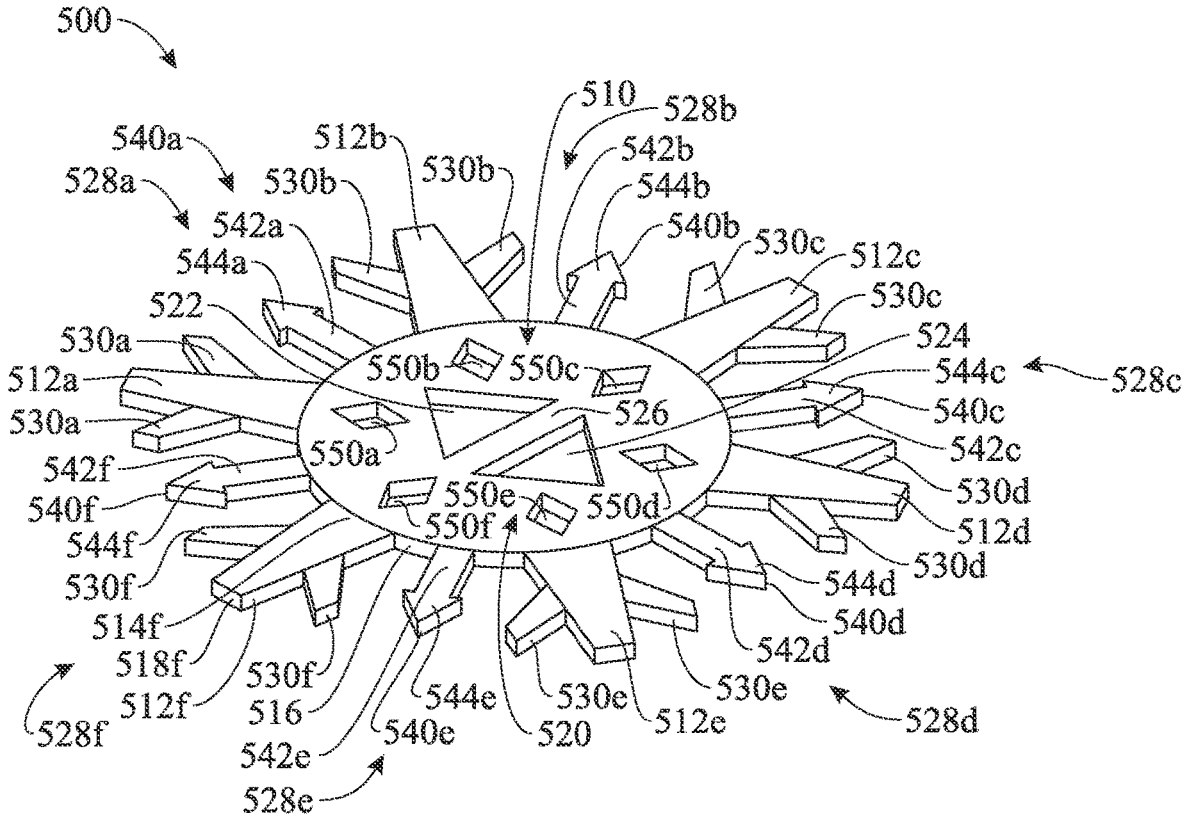
FIG. 10A presents a top, side isometric view of a removable ice restraining device for restraining ice within a container in accordance with a fifth illustrative embodiment of the present invention in a relaxed condition and having a second snowflake shape, triangular finger ports and additional fluid passage ports.
Figure 10B:
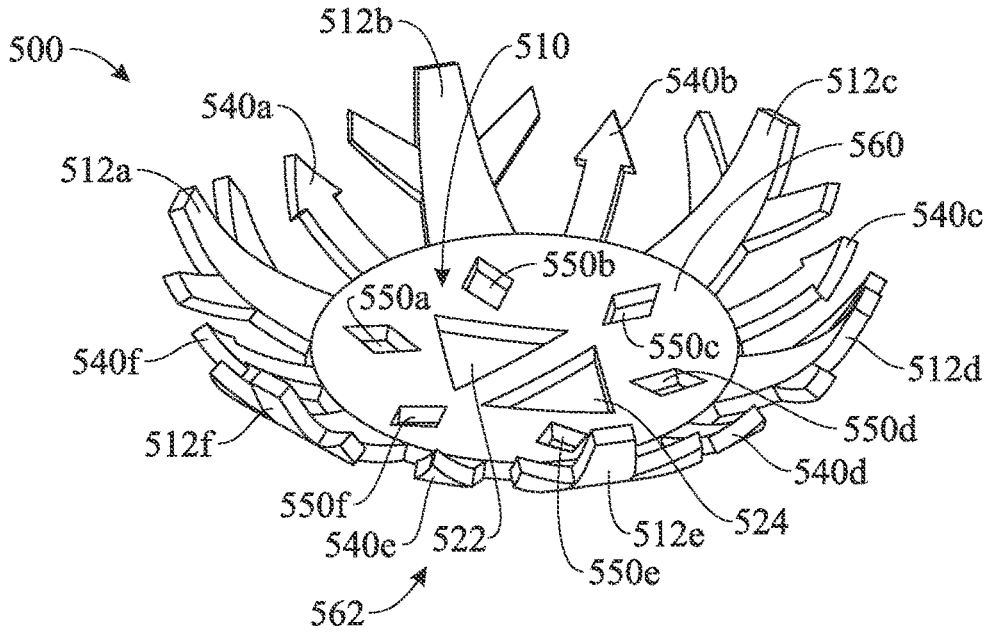
FIG. 10B presents a top, side isometric view of a removable ice restraining device for restraining ice within a container of FIG. 10A in a flexed condition.

Turning now to FIGS. 10A and 10B, there is disclosed another embodiment of an ice restraining device 500. The ice restraining device 500 includes a circular central finger grip portion 510 having securing arms 512 extending radially outward of the finger grip portion 510. For example, securing arm 512*f* includes a first end 514*f* extending from an outer edge 516 of the finger grip portion 410 and terminating in a free second end 518*f*. Similar to those embodiments above, the finger grip portion 510 defines a pair of finger grip ports 520 including a first finger grip port 522 and a second finger grip port 524. The first and second finger grip ports 522 and 524 are triangular and are separated by a spacer 526. As above, the securing arms 512*a-f* define primary perforated areas 528*a-f* therebetween. In this particular embodiment, each of the securing arms 512*a-f* includes a pair of extension arms 530*a-f* extending from the securing arms 512*a-f* and extending into the primary perforated areas 528*a-f*. The extension arms 530*a-f* provide additional surface area to engage the inner surface 3010 of the container 3000 and retain the ice restraining device 500 within the container 3000.

The ice restraining device 500 further includes decorative arms 540*a-f* extending radially outward from the outer edge 516 of the finger grip portion 510 and extending into the primary perforated areas 528*a-f*. In an embodiment, the securing arms 512 may correspond to primary securing arms of the ice restraining device 500 and the decorative arms 540*a-f* correspond to secondary arms of the ice restraining device 500 The decorative arms 540*a-f* are in the shape of arrows having shafts 542*a-f* terminating in points 544*a-f*.

In order to increase liquid flow through the ice restraining device 500, the finger grip portion 510 further defines secondary perforated areas 550*a-f* through which liquid can flow. In this embodiment, the secondary perforated areas 550*a-f* are diamond shaped.

With specific reference to FIG. 10B, and similar to those embodiment described hereinabove, the ice restraining device 500 has a first side 560 and a second side 562. When forced into the container 3000, the first side 560 assumes a concave shape and the second side assumes a convex shape.

The ice restraining device 500 is formed from a food grade silicone material. The finger grip portion 510 and the securing arms 512 and decorative arms 540 may be formed separately and joined along the outer edge 516 of the finger grip portion 510 by various methods such as, for example welding, fusing, gluing, etc. Alternatively, the finger grip portion 510, the securing arms 512 and the decorative arms 540 may be formed integrally as described hereinabove. Thus, the disclosed ice restraining devices form novel structures for retaining ice cubes within a container without affecting the taste of the liquid contained therein.

Figure 11A:
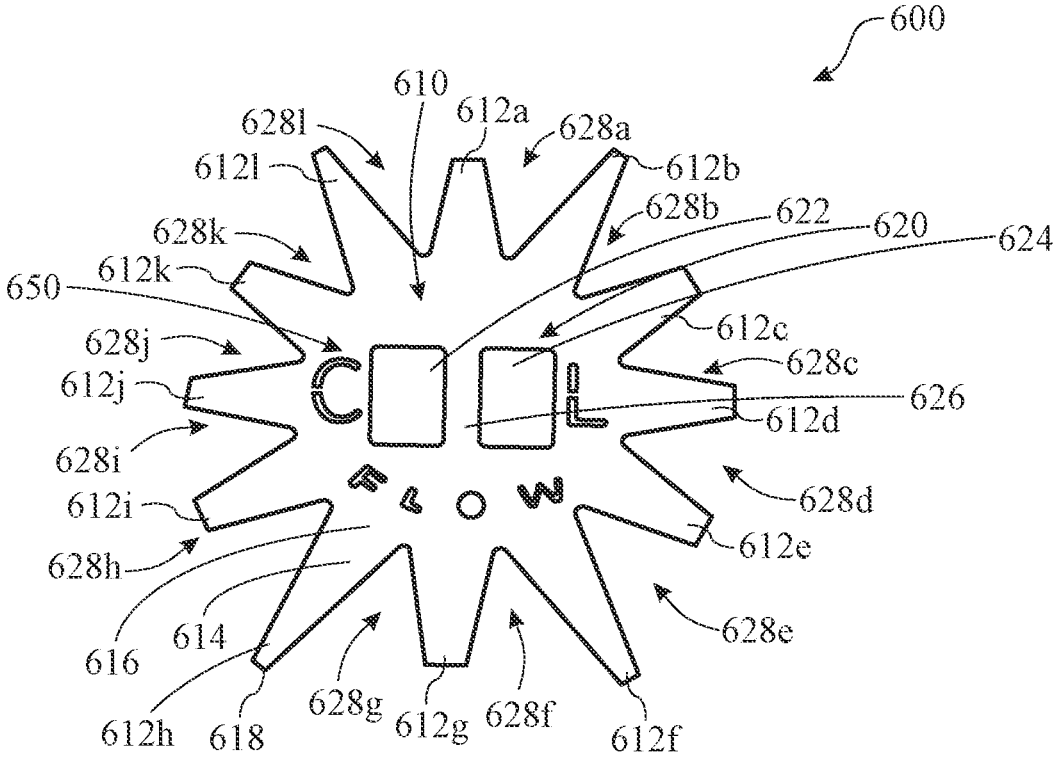
FIG. 11A presents top view of an ice restraining device for restraining ice within a container in accordance with a sixth illustrative embodiment of the present invention.
Figure 11B:
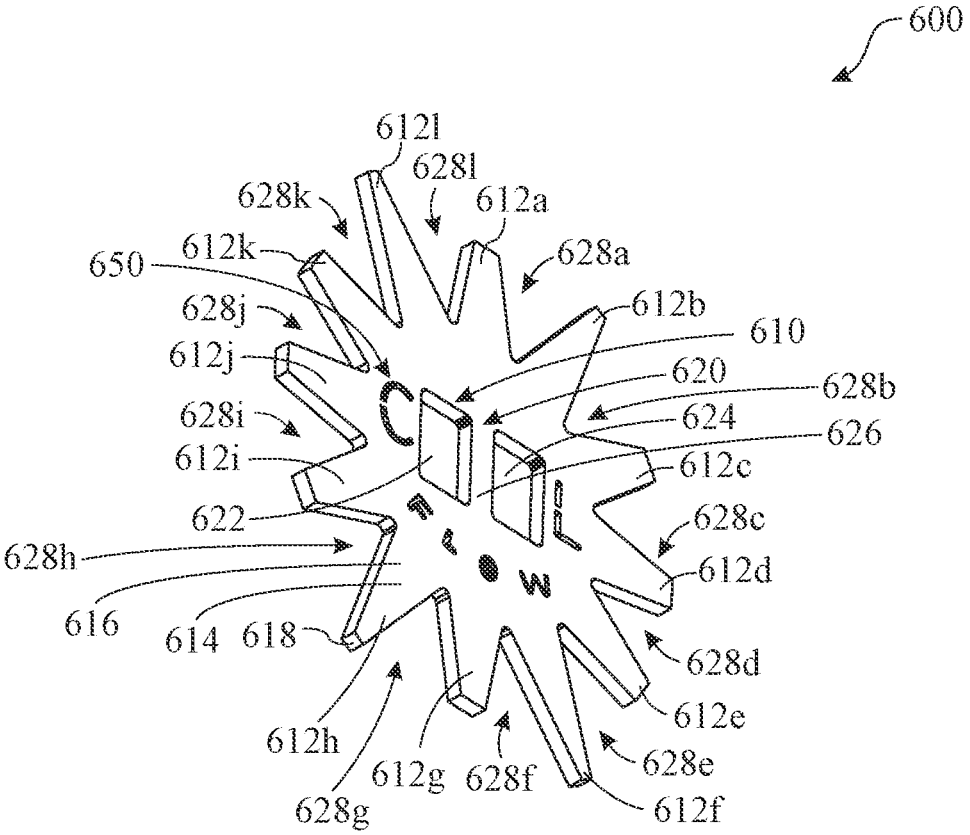
FIG. 11B presents a top, side isometric view of the ice restraining device for restraining ice within a container in accordance with the sixth illustrative embodiment of the present invention.

Referring to FIGS. 11A-11B, there is disclosed a flexible ice restraining device 600 for use in restraining ice within a container, in accordance with a sixth exemplary embodiment of the present invention FIG. 11A illustrates a top view of the ice restraining device 600 while FIG. 11B illustrates a top, side-isometric view of the ice restraining device 600. The ice restraining device 600 includes a central finger grip portion 610 and a plurality of flexible securing arms 612*a*-1 (collectively referred to as arms 612) extending radially outward from the finger grip portion 610. It should be noted that, while twelve securing arms 612*a*-1 are illustrated, the disclosed ice restraining device 600 may be provided with more or fewer securing arms 612.

Each securing arm 612 includes a first end 614 extending from an outer edge 616 of the finger grip portion 610. Each securing arm 612 further includes a free second end 618 for engaging an interior of the container in which the ice restraining device 600 is to be inserted. The first and second ends 614, 618 have been depicted with reference to securing arm 612*h* in FIGS. 11A-11B.

The plurality of flexible securing arms 612*a-l* may include a first set of securing arms and a second set of securing arms. The first set of securing arms may include arms 612*b*, 612*f*, 612*h*, and 612*l* and the second set of securing arms may include arms 612*a*, 612*c*, 612*d*, 612*e*, 612*g*, 612*i*, 612*j*, and 612*k*. The first set of securing arms may have a different configuration as compared to the second set of securing arms. Each of the first set of securing arms may have a first length L1 and each of the second set of securing arms may have a second length L2, where L1 is greater than L2. That is, each of the first set of securing arms may be longer in length as compared to each of the second set of securing arms.

Additionally, the first set of securing arms may have a different shape as compared to the second set of securing arms. The first set of securing arms and the second set of securing arms may each have a triangular shape terminating in the corresponding second ends 618, however, the corresponding second ends 618 of the first set of securing arms may be narrower than the corresponding second ends 618 of the second set of securing arms. In an embodiment, the length L1 of the first set of securing arms may be 1.125 mm and the width of the first set of securing arms at the second end 618 may be 0.11 mm.

Further, the ice restraining device 600 may have perforated areas 628*a-l* defined between the securing arms 612*a*-1. When the ice restraining device 600 is inserted into the container to restrain ice therein, liquid located within the container is free to flow between the securing arms 612*a*-1 through the perforated areas 628*a*-1, similar to the manner as explained above with reference to FIGS. 5-6.

In order to facilitate insertion and removal of the ice restraining device 600 into and out of an interior of the container, the finger grip portion 610 includes a pair of finger grip ports 620, in particular, a first finger grip port 622 and a second finger grip port 624. As depicted, the first finger grip port 622 and the second finger grip port 624 may be rectangular shaped ports configured to receive fingers of a user to facilitate manipulation of the ice restraining device 600 relative to a container. In an embodiment, each of the first finger grip port 622 and the second finger grip port 624 may have dimensions of about 0.75×0.5 mm. As depicted, the first finger grip port 622 and the second finger grip port 624 may be spaced apart by a length of a spacer 626 formed in the finger grip portion 610.

The ice restraining device 600 may be inserted into the container having an internal diameter smaller than an outer diameter of the ice restraining device 600. When inserted, at least one of the first set of securing arms and the second set of securing arms flex against an interior of the container. The ice restraining device 600 may assume a concave/convex shape (as also described above with respect to other embodiments) due to the flexing of the at least one of the first set of securing arms and the second set of securing arms, thereby securing the ice restraining device 600 within the container and over ice cubes within the container. Further, due to the variable lengths of the first set of securing arms and the second set of securing arms, the first set of securing arms may initially be in contact with the interior of the container to secure the ice restraining device 600 within the container. In case the user desires to further insert the ice restraining device 600 into the container or more securely restrict the ice restraining device 600 within the container, the user may push the ice restraining device 600 into the container such that the second set of securing arms also come into contact with the interior of the container, thereby more securely keeping the ice restraining device 600 within the container.

In an embodiment, the ice restraining device 600 may have additional aesthetic elements, such as, a logo or a design provided on the ice restraining device 600. For instance, a logo 650 is illustrated in FIGS. 11A-11B. In an embodiment, the logo 650 may be provided on the finger grip portion 610.

The ice restraining device 600 may be formed from food grade silicon, thereby keeping the ice restraining device 600 non-toxic. Further, the ice restraining device 600 does not affect the taste of a beverage that it may come into contact with within the container. In an embodiment, the ice restraining device 600 is formed from a sheet of food grade silicone having a thickness t of about ⅛ mm. The ice restraining device 600 thus allows retaining ice cubes within a container without affecting the taste of the liquid contained therein.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A flexible ice restraining device for restraining ice cubes within a container, the ice restraining device comprising:

a central finger grip portion comprising a pair of finger ports configured to receive fingers of a user to facilitate manipulation of the ice restraining device relative to the container;

a plurality of securing arms extending radially outward from the central finger grip portion, wherein the plurality of securing arms are configured to flex when in engagement with an interior of the container thereby shifting the ice restraining device from a relaxed condition to a flexed condition; and a plurality of perforated areas formed between corresponding securing arms of the plurality of securing arms, wherein the plurality of perforated areas are configured to allow a liquid within the container to pass there-through while the central finger grip portion and the plurality of securing arms restrain the ice cubes within the container, wherein the plurality of securing arms comprise a plurality of primary securing arms, wherein the plurality of perforated areas comprise a plurality of primary perforated areas formed between corresponding securing arms of the plurality of primary securing arms, and wherein each of the plurality of primary securing arms comprise a pair of extension arms extending from corresponding primary securing arms into the corresponding primary perforated areas.

2. The flexible ice restraining device of claim 1, wherein the ice restraining device is formed of a sheet of food grade silicon.

3. The flexible ice restraining device of claim 1, wherein each securing arm of the plurality of securing arms comprises a first end adjacent the central finger grip portion and a free second end for engaging the interior of the container upon being inserted within the container.

4. The flexible ice restraining device of claim 3, wherein each securing arm of the plurality of securing arms has a rectangular configuration.

5. The flexible ice restraining device of claim 3, wherein each securing arm of the plurality of securing arms has a triangular configuration.

6. The flexible ice restraining device of claim 1, wherein the central finger grip portion and the plurality of securing arms are integrally formed.

7. The flexible ice restraining device of claim 1, wherein the pair of finger ports comprise a first finger grip port and a second finger grip port spaced part from the first finger grip port, and wherein each of the first finger grip port and the second finger grip port are D-shaped ports.

8. The flexible ice restraining device of claim 1, wherein the pair of finger ports comprise a first finger grip port and a second finger grip port spaced part from the first finger grip port, and wherein each of the first finger grip port and the second finger grip port are circular ports.

9. A flexible ice restraining device for restraining ice cubes within a container, the ice restraining device comprising:

a central finger grip portion comprising a pair of finger ports configured to receive fingers of a user to facilitate manipulation of the ice restraining device relative to the container;

a first set of securing arms and a second set of securing arms extending radially outward from the central finger grip portion, wherein each of the first set of securing arms and the second set of securing arms are configured to flex when in engagement with an interior of the container; and a plurality of perforated areas formed between corresponding securing arms of the first set of securing arms and the second set of securing arms, wherein the plurality of perforated areas are configured to allow a liquid within the container to pass there-through while the central finger grip portion, the first set of securing arms, and the second set of securing arms restrain the ice cubes within the container, wherein the first set of securing arms have a greater length compared to the length of the second set of securing arms.

10. The flexible ice restraining device of claim 9, wherein each securing arm of the first set of securing arms and the second set of securing arms comprise a first end adjacent the central finger grip portion and a free second end for engaging the interior of the container upon being inserted within the container, and wherein the second ends of the first set of securing arms are narrower compared to the second ends of the second set of securing arms.

11. The flexible ice restraining device of claim 9, wherein the pair of finger ports comprise a first finger grip port and a second finger grip port spaced part from the first finger grip port, and wherein each of the first finger grip port and the second finger grip port are rectangular ports.

12. The flexible ice restraining device of claim 9, wherein the ice restraining device is formed of a sheet of food grade silicon.

13. A flexible ice restraining device for restraining ice cubes within a container, the ice restraining device comprising:

a central finger grip portion comprising a pair of finger ports configured to receive fingers of a user to facilitate manipulation of the ice restraining device relative to the container;

a plurality of primary securing arms extending radially outward from the central finger grip portion;

a plurality of primary perforated areas formed between corresponding securing arms of the plurality of primary securing arms; and a plurality of secondary arms extending radially outward from the central finger grip portion and extending into the plurality of primary perforated areas;

a plurality of secondary perforated areas defined between corresponding secondary arms and the central finger grip portion, the plurality of secondary perforated areas being configured to allow the liquid within the container to pass there-through, wherein at least the plurality of primary securing arms are configured to flex when in engagement with an interior of the container, and wherein the plurality of primary perforated areas are configured to allow a liquid within the container to pass there-through while the central finger grip portion, the plurality of primary securing arms, and the plurality of secondary arms restrain the ice cubes within the container.

14. The flexible ice restraining device of claim 13, wherein each of the plurality of primary securing arms comprise a pair of extension arms extending from corresponding primary securing arms into the corresponding primary perforated areas.

15. The flexible ice restraining device of claim 13, wherein the ice restraining device is formed of a sheet of food grade silicon.

16. The flexible ice restraining device of claim 13, wherein the pair of finger ports comprise a first finger grip port and a second finger grip port spaced part from the first finger grip port, and wherein each of the first finger grip port and the second finger grip port are triangular ports.

17. The flexible ice restraining device of claim 13, wherein each of the plurality of secondary perforated areas are diamond shaped.

18. The flexible ice restraining device of claim 13, wherein each of the plurality of secondary perforated areas are triangular shaped.

* * * * *